United States Patent [19]

Schoewe

[11] Patent Number: 4,807,817

[45] Date of Patent: Feb. 28, 1989

[54] COMMINUTING AND WINDING APPARATUS

[76] Inventor: David G. Schoewe, P.O. Box 18271, Tampa, Fla. 33679

[21] Appl. No.: 165,612

[22] Filed: Mar. 8, 1988

[51] Int. Cl.[4] ..... B02C 13/30

[52] U.S. Cl. ..... 241/100; 241/101.2; 241/101.7; 241/190; 241/DIG. 38; 242/82

[58] Field of Search ..... 72/169, 146, 142, 148, 72/298, 388; 242/78, 82; 241/190, 101.2, DIG. 38, 100, 101.7, 189 R, 100

[56] References Cited

U.S. PATENT DOCUMENTS

| | | | |
|---|---|---|---|
| 2,060,126 | 11/1936 | Scheynost . | |
| 2,986,186 | 5/1961 | White | 241/190 X |
| 3,625,448 | 12/1971 | Griffiths | 242/78 |
| 3,691,807 | 9/1972 | Jasper et al. . | |
| 3,806,047 | 4/1974 | Ober . | |
| 3,874,604 | 4/1975 | Gronberg et al. . | |
| 3,974,969 | 8/1976 | Herbst, Sr. . | |
| 4,109,879 | 8/1978 | Properzi | 242/80 |
| 4,125,006 | 11/1978 | Bueche . | |
| 4,403,743 | 9/1983 | Ducasse . | |

*Primary Examiner*—Mark Rosenbaum
*Attorney, Agent, or Firm*—Pettis & McDonald

[57] ABSTRACT

An apparatus is disclosed for comminuting gypsum board and winding elongate bendable members. The apparatus includes a support structure and a comminuting mechanism, including a housing mounted to the support structure. The housing has an intake portion for receiving gypsum board to be comminuted, an outlet portion for discharging comminuted material, and one or more blades rotably mounted in the housing. There is a winding mechanism that includes a winding shaft axially rotatably mounted to the support structure. The winding shaft has a slot disposed therein for receiving an elongate bendable member to be wound. There is a holder device mounted to the support structure and spaced apart from the winding shaft for accommodating the member to be wound at a location spaced apart from the portion of the member received by the slot in the winding shaft. The comminuting blade assembly is rotatably driven to comminute gypsum board that is introduced into the housing and the winding shaft is rotatably driven to wind a bendable member received in the slot about the winding shaft.

21 Claims, 3 Drawing Sheets

COMMINUTING AND WINDING APPARATUS

BACKGROUND OF THE INVENTION

This invention relates to an apparatus for both comminuting bulk materials and winding elongate bendable members and, more particularly, to an apparatus which breaks up construction materials such as gypsum board drywall and winds elongate metal studs.

In the construction industry, the storage and transportation of waste materials is a significant concern. When buildings are torn down or renovated, debris such as old gypsum board drywall and building studs must be collected and disposed of, preferably in the most convenient and efficient manner possible. However, this operation is often complicated because large chunks of waste drywall may be quite heavy and awkward and often cannot be compactly loaded into bags, dumpsters or other trash containers. As a result, the building contractor is forced to incur added expenses for storing and disposing of the waste materials. Additional trash receptacles may be required and time delays can result.

Various machines are known that are capable of crushing metal building studs and making them more compact for disposal. However, such machines are typically large, expensive and inconvenient for use at the building site. Moreover, no machines are presently available for compacting both the building studs and the drywall or other bulk construction rubble produced at the construction site.

SUMMARY OF THE INVENTION

It is therefore an object of the invention to provide an apparatus that both comminutes gypsum board and winds elongate bendable members.

It is a further object of this invention to provide a comminuting and winding apparatus that quickly and efficiently compacts building waste material such as gypsum board and metal studs to facilitate storage and disposal of that material.

It is a further object of this invention to provide a comminuting and winding apparatus that is conveniently and compactly constructed on a single support structure and well suited for use at construction sites.

This invention results from a realization that waste materials, such as debris produced in the demolition or rehabilitation of buildings, can be quickly and efficiently reduced in size for disposal or packaged for recycling by a compact machine that employs a comminuting mechanism for grinding bulk material such as gypsum board, and a winding mechanism for compacting elongate bendable members such as metal building studs, both mechanisms being mounted on a single support structure. In particular, this invention features an apparatus that includes a support structure, a comminuting mechanism and a winding mechanism. The comminuting mechanism includes a housing mounted to the support structure. The housing has an intake portion for receiving materials to be comminuted and an outlet portion for discharging comminuted material. Blades are rotatably mounted in the housing. The winding mechanism includes a winding shaft axially rotatably mounted to the support structure and having slot means disposed in the winding shaft for receiving an elongate bendable member to be wound. There is a holder device mounted to the support structure and spaced apart from the winding shaft for accommodating the bendable member to be wound at a location spaced apart from the portion of the bendable member that is received by the slot means in the winding shaft. Apparatus is mounted to the support structure for rotatably driving the blade means to comminute the bulk material that is introduced into the housing and for rotatably driving the winding shaft to wind the bendable member received in a slot means about the winding shaft.

In preferred embodiments the apparatus for rotatably driving may include either a single motor that operates both the comminuting mechanism and the winding mechanism, or alternatively, separate motors associated with each of the comminuting mechanism and winding mechanism. A plurality of speed reducers may be employed to reduce the speed of each driving motor to the speeds desired for the rotating blades and rotating winding shaft, respectively. The blades may include a plurality of rotary blade elements that extend from a comminuting shaft that is axially rotatably mounted in the housing, and the comminuting mechanism may further comprise a frame device including a plurality of meshing elements fixably attached in the housing for meshing with the blade elements as the blade elements are rotated. To improve the grinding efficiency of the comminuting mechanism, the blade elements may be bent in a direction longitudinally of the comminuting shaft.

BRIEF DESCRIPTION OF THE DRAWINGS

A particularly preferred embodiment of the apparatus of this invention will be described in detail below in connection with the illustrations in which.

DESCRIPTION OF PREFERRED EMBODIMENT

Figure 2:
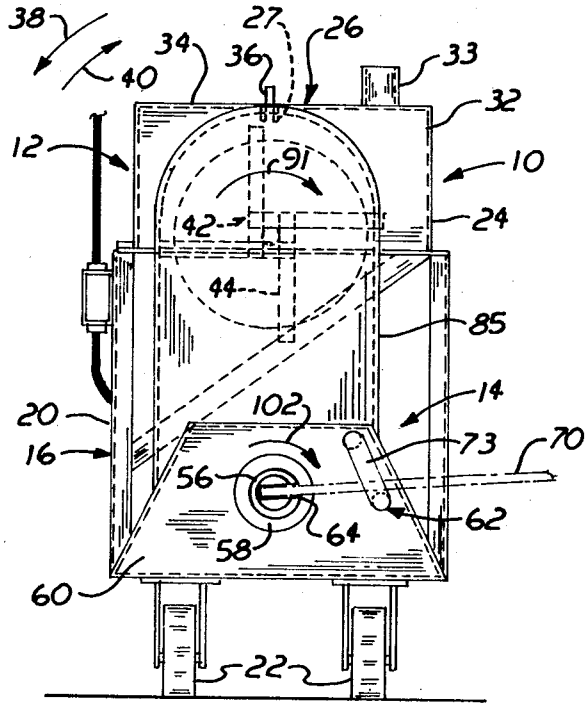
FIG. 2 is a side elevational view of the apparatus of FIG. 1.
Figure 3:
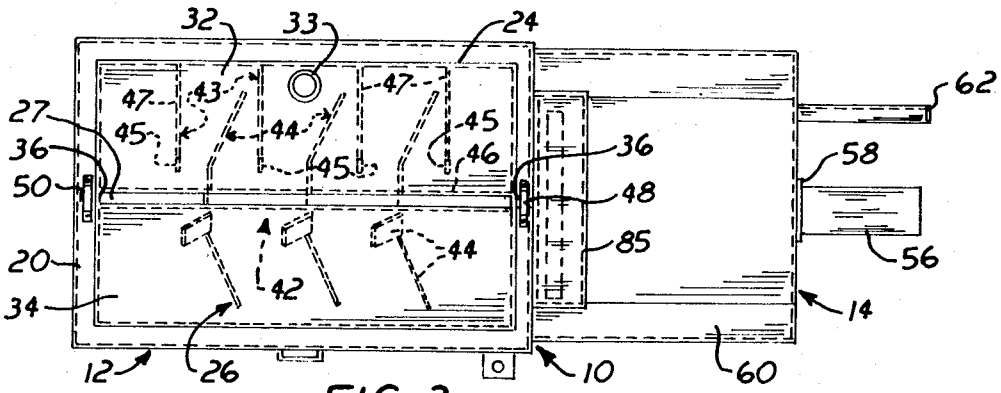
FIG. 3 is a top plan view of the apparatus of FIG. 1.
Figure 1:
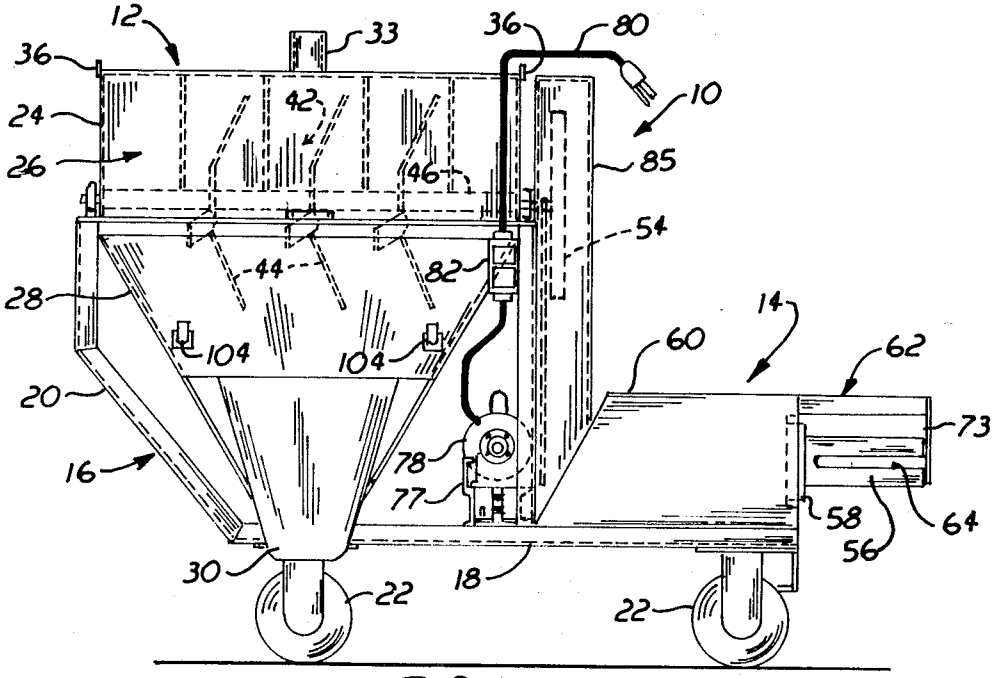
FIG. 1 is a front elevational view of the comminuting and winding apparatus of this invention.

There is shown in FIGS. 1 through 3 a comminuting and winding apparatus 10 according to this invention including a comminuting mechanism 12 for comminuting bulk materials such as gypsum board drywall, and a winding mechanism 14 for winding elongate bendable members such as metal building studs. Mechanisms 12 and 14 are mounted on a support structure 16 that includes a base 18 and a support frame 20. Four support wheels 22, attached in a conventional manner to the bottom of base 18, enable apparatus 10 to be moved conveniently around the work site and to and from a suitable vehicle for transport to and from the work site.

As best shown in FIGS. 1 through 3, comminuting device 10 includes a housing 24 that is mounted to support structure 16 by bolts, welding or other suitable attachment means. Housing 24 includes a relatively large intake portion 26 formed at its upper end. As best shown in FIG. 3, intake portion 26 includes an elongate opening or slot 27 formed in the upper surface of intake portion 26. Slot 27 is generally wide enough to receive a piece of gypsum board 90 to be comminuted in the manner shown and described in connection with FIG. 4. As best shown in FIG. 1, the housing 24 further includes a tapered intermediate portion 28 and a lower outlet portion, in the form of a discharge chute 30. Intake portion 26 includes a rearward section 32 located rearwardly of opening 27 and a lid 34 that is located forwardly of opening 27 and pivotally attached to rearward section 32 by hinges 36, as illustrated in FIGS. 1 through 3, proximate the ends of slot 27. As shown in FIG. 2, lid 34 may be selectively closed in the direction of arrow 38 so that the intake portion 26 of housing 24 is closed during operation of the mechanism 12. Alternatively, lid 34 may be pivoted open in the direction of arrow 40 to expose the intake portion 26 of housing 24 so that the housing 24 of mechanism 12 may be cleaned in a manner shown and described further in connection with FIG. 4.

Port means, which may comprise a pipe or vent 33, are typically formed in housing 24 somewhere above the discharge chute 30, for example, in rearward section 32 of housing 24. Vent 33 provides means for exhausting dust and other particles that are generated in the comminution process. A vacuum device may be attached to vent 33 to collect such particles. As a result the grinding is performed more efficiently and the discharge of annoying dust particles is reduced.

The housing and support structure of this invention are typically composed of rugged metal or metal alloy materials. However, various other materials such as plastic may be also be employed.

Figure 4:
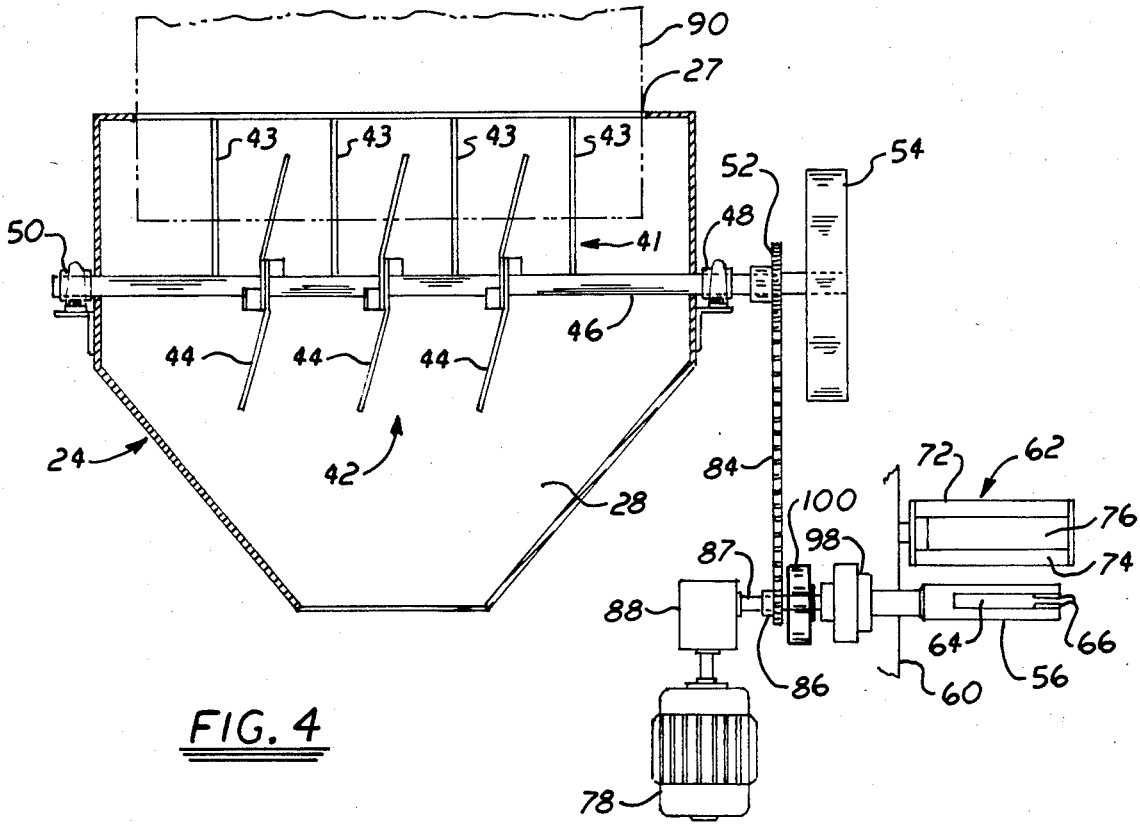
FIG. 4 is a simplified schematic view of the comminuting and winding mechanisms and a single motor for driving both mechanisms.

As illustrated in FIGS. 1 through 3, comminuting mechanism 12 also includes blade means 42 that are rotatably mounted within housing 24. The blade means 42 may comprise a plurality of rotary blade elements 44 that are attached to and extend generally radially from a comminuting shaft 46. As best shown in FIG. 4 shaft 46 extends through openings in the side walls of housing 24 and is rotatably supported by bearings 48 and 50. The blade elements are suitably shown arranged along shaft 46 in groups of four. However, in alternative embodiments, various other blade arrangements and shapes may be utilized. Preferably, the blade elements 44 are constructed of steel or other suitable metal alloys and are attached to shaft 46 by welding or other conventional means.

A frame device 41, that comprises a plurality of generally L-shaped meshing elements 43, is mounted to rearward section 32 of housing 24. As best shown in FIG. 3 each meshing element 43 includes a generally vertical elongate piece 45 that is attached at one end by welding or other means to the inner top surface of intake portion 26 of housing 24. Each meshing element 43 also includes a generally horizontal elongate piece 47 that is similarly attached at one end to the inner back surface of intake portion 26 and at its opposite end to the lower end of a respective generally vertical meshing piece 45. The meshing elements are likewise preferably constructed of steel or other durable metal or synthetic materials.

As best shown in FIGS. 1, 3 and 4, each blade element 44 is bent at an intermediate point along its length at an angle generally longitudinally of shaft 46 and toward a respective meshing element 43. As the blade elements 44 are rotated, in the manner described below, each blade element passes between an adjacent pair of meshing elements 43.

Figure 5:
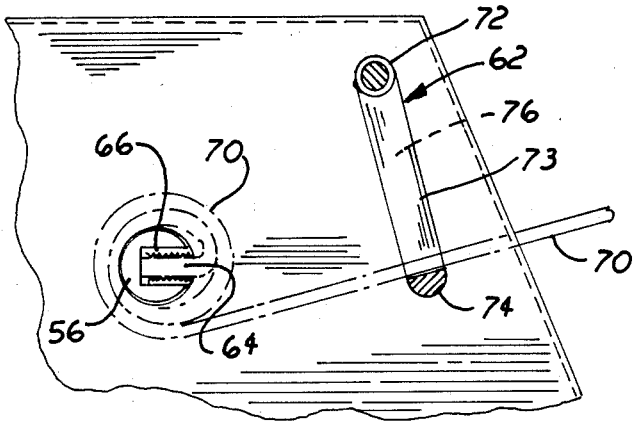
FIG. 5 is a side elevational view of the winding mechanism in operation, winding a bendable member.

Winding mechanism 14 includes a winding shaft 56 mounted to base 18 of support structure 16. Shaft 56 is rotatably supported by a bearing 58 that is mounted in the side of a winding mechanism casing 60. The winding mechanism casing 60 is itself mounted in a conventional manner on base 18 of support structure 16. As shown in FIGS. 1, 2, 4 and 5, winding shaft 56 is preferably cylindrical in shape, although alternative non-cylindrical shapes may be employed. Shaft 56 is preferably composed of steel or other durable metal or metal alloy materials. The winding shaft 56 includes longitudinal slot means 64 that extend inwardly from the outer end of shaft 56. In this embodiment, slot means 64 are disclosed as a single longitudinal slot in the cylindrical shaft 56. In alternative embodiments, however, the slot means may comprise a pair of opposing slots disposed longitudinally in the shaft. Furthermore, the slots need not extend from the outer end of the winding shaft. As shown in FIGS. 4 and 5, the tubular winding shaft 56 may include a pair of gripping elements 66 attached to the edges of slot means 64 and extending into the bore of the tubular shaft. Gripping elements 66 include teeth or other similar gripping elements that improve the grip upon a bendable member 70 that is inserted into slot means 64.

A holder device 62 is attached to, and extends from the side wall of winding mechanism casing 60 and is spaced apart from winding shaft 56. As shown in FIGS. 1, 2, 4 and 5, holder 62 includes a pair of spaced apart bars 72 and 74 connected by a piece 73. A space 76 is formed between the bars 72 and 74. Space 76 has a size which is sufficient to accommodate the bendable member 70 to be bent.

Comminuting mechanism 12 and winding mechanism 14 are both driven by a single motor 78, shown in FIGS. 1 and 4. Motor 78 is typically an electric motor with an output of approximately 2 horsepower, although this is not a limitation of the invention. As best shown in FIG. 1, motor 78 is mounted by a bracket 77 or other suitable means to base 18 of support structure 16. Motor 78 is provided with an electrical cord 80 for attachment to a power source and an on/off switch 82 that permits selective operation of apparatus 10.

As best shown in FIG. 4, motor 78 is connected through speed reduction means, comprising a right angle speed reducer 88, to a shaft 87. A first sprocket 86 is axially mounted on shaft 87 and a second sprocket 52 is similarly mounted on comminuting shaft 46. An endless chain 84 is interconnected between, and operatively engages sprockets 52 and 86. A flywheel 54 is axially mounted proximate the end of comminuting shaft 46, as shown in FIGS. 1 through 3. A cover 85 may be disposed over flywheel 54, gears 86 and 52 and chain 84 to prevent dust and debris from interferring with the operation of the chain. Shaft 87 is also connected to winding shaft 56 through an electric clutch 98 and a second speed reducer 100.

In operation motor 78 is activated by switch 82. This causes shaft 87 and first gear 86 to rotate and, in turn, the chain 84 drives second sprocket 52 to rotate shaft 46. This causes blade elements 44 to rotate in the direction of arrow 91, shown in FIG. 2, and to break up the gypsum board 90, shown in FIG. 4, that is introduced into housing 24 of comminuting mechanism 12 through slot 27. In particular, the blade elements 44 mesh with meshing elements 43, and because blade elements 44 are angled toward respective meshing elements 43, an improved comminuting operation is achieved. Flywheel 54 attached proximate the end of shaft 46 provides the shaft and blade elements 44 with increased momentum and therefore enhances the comminution process even further.

During operation, lid 34 remains closed and intake slot 27 is narrow enough so that the operator's hands are prevented from being inadvertantly introduced into the housing and injured by the rotary blades. Moreover, the narrow slot and closed lid help to contain comminuted material in the housing and thereby serve to protect workers from flying debris. Following the comminution process, lid 34 may be opened so that access is provided to the interior of housing 24. This enables the housing to be thoroughly cleaned for later use.

The right angle speed reducer 88 is employed so that the operating speed of the motor 78 is reduced to a level suitable for driving comminuting shaft 46 and rotary blades 44. For example, a preferred comminuting shaft speed is approximately 150 rpm. Accordingly, if a motor having an operating speed of 3600 rpm is employed, a speed reducer having a ratio of approximately 24:1 may be utilized. Of course, the operating speed of the comminuting shaft is not a limitation of this invention. In other embodiments, various alternative comminuting shaft speeds and speed reduction ratios may be employed.

Material that is broken up within housing 24 drops through intermediate portion 28 of the housing 24 and out through discharge chute 30. A bag or other debris container may be attached to chute 30 such as by clips, hooks or other suitable means 104 to facilitate removal of the comminuted material.

Motor 78 likewise serves to drive winding shaft 56 of winding mechanism 14. In particular, shaft 87 is rotated and its speed is suitably reduced by a conventional speed reducer 100. Electric clutch 98 is conventionally operated by an electric switch, not shown. When the clutch is engaged, rotary motion is transmitted from second speed reducer 100 to winding shaft 56, so that shaft 56 is axially rotated. The gear reduction ratio of the speed reducer is again selected so that a desired rotational speed (for example, 35 rpm) is imparted to the winding shaft 56.

Before shaft 56 is activated, a bendable member 70 is introduced through space 76 in holder 62 and one end of the member 70 is inserted into the slot means 64 in winding shaft 56. The winding shaft is then rotated, either by engaging electric clutch 98 or, if no clutch is provided, simply by activating motor 78. As a result, winding shaft 56 is driven in the direction of arrow 102, shown in FIG. 2, and bendable member 70 is wound about shaft 56 in the manner shown in FIG. 5. Holder 62 holds member 70 in place and guides the member 70 through space 76 as it is wound about shaft 56. After the free end of member 70 has passed through holder 62, the wound member is removed from shaft 56 and discarded. If no members are available for winding the winding mechanism 14 may be halted by disengaging electric clutch 98.

In alternative embodiments, a single motor need not operate both comminution shaft 46 and winding shaft 56. Rather, a separate motor and speed reducer may be attached to drive the winding shaft 56 and that motor may be disposed within winding mechanism casing 60.

Figure 7:
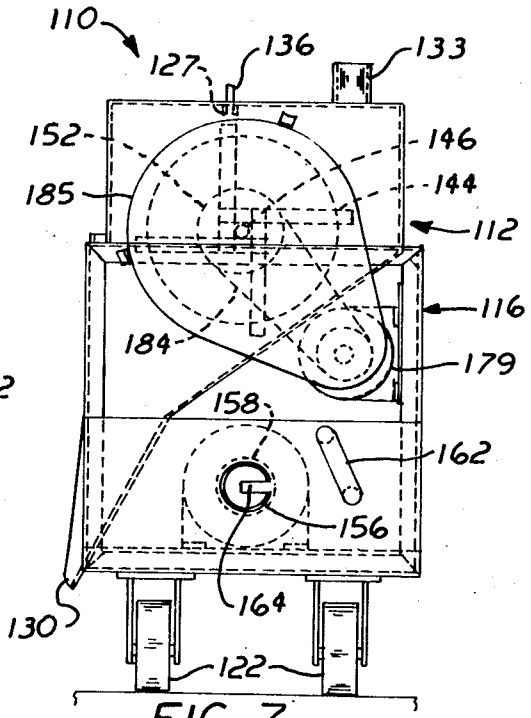
FIG. 7 is a side elevational view of the apparatus of FIG. 6.
Figure 6:
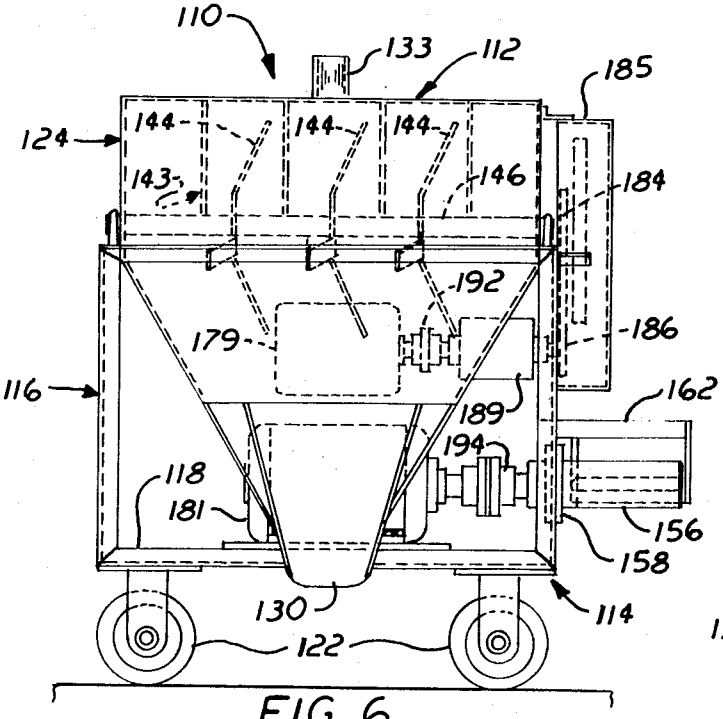
FIG. 6 is a front elevational view of an alternative preferred comminuting and winding apparatus according to this invention, which apparatus includes a pair of motors for driving the comminuting and winding mechanisms respectively.

A alternative preferred comminution and grinding apparatus 110 is shown in FIGS. 6 and 7. This apparatus likewise includes a support structure 116 for supporting a comminution mechanism 112 and a winding mechanism 114. Comminution mechanism 112 includes a housing 124 as previously described, having a plurality of rotary blade elements 144 mounted in the housing by a comminution shaft 146. Shaft 146 is axially rotatably driven by a first motor 179.

Motor 179 is supported by brackets or other suitable mounting means to the rear wall of support structure 116, generally beneath housing 124. Alternatively, motor 179 may be attached to other portions of support structure 116 in any manner that does not interfere with the winding mechanism 114. Motor 179 is connected by a coupling device 192 to a speed reducer 189 that reduces the speed of the motor to a level desired for comminuting shaft 146. The rotary output from speed reducer 189 drives a first sprocket 186. A chain 184 operatively interconnects sprocket 186 and a second sprocket 152 that is axially mounted on comminuting shaft 146. In operation, the motor is activated to drive chain 184 and, as a result, shaft 146 and blade elements 144 are rotatably driven at a desired speed to comminute gypsum board introduced into housing 124 through slot 127. The comminuted material is then discharged in the manner previously described through chute 130 of comminuting housing 124.

Winding mechanism 114 again includes a winding shaft 156 as previously described. Shaft 156 is axially rotatably supported by a bearing 158 mounted in the side of support structure 116. A support holder 162 is attached to the side of support structure 116 and is spaced apart from winding shaft 156.

Winding shaft 156 is driven by a second motor 181 that is mounted to the base 118 of support structure 116. More specifically, motor 181 is connected to winding shaft 156 through a coupling element 194. Motor 181 may include a conventional internal speed reduction mechanism, not shown, or, alternatively, an external speed reducer, analogous to reducer 189, may be used to reduce the rotational speed of the winding shaft 156 to a desired level. Indeed, in each of the embodiments of this invention an internally speed reduced motor may be substituted for an arrangement featuring a motor and a distinct external speed reduction device.

A bendable member is introduced through holder 162 and into slotted shaft 156 and winding mechanism 114 is operated by activating motor 181 to wind the bendable member about winding shaft 156 in the manner previously described. In the latter embodiment, the winding mechanism 114 and the comminuting mechanism 112 are operated independently of one another. Each motor 179 and 181 is provided with its own switch so that the comminuting and winding mechanisms may be selectively operated either one at a time or contemporaneously. Because the second motor 181 is positioned beneath the housing 124 of comminuting mechanism 112, the latter embodiment provides a very compact structure. Apparatus 110 may be conveniently stored and transported without taking up an undesirably large amount of space. In all other manners, the latter embodiment operates analogously to the previous embodiment. Therefore, similar features that have not been discussed in detail have been provided with similar reference numbers, increased by one hundred.

From the foregoing it may be seen that this invention provides for a compact and efficient machine for quickly and conveniently compacting bulk materials and elongate bendable members. As a result this apparatus permits such materials to be disposed of much more conveniently and inexpensively than has been previously possible. Bulk debris is greatly reduced in size so that removal from the buildings being renovated is facilitated and damage to the walls, ceilings and elevators is also greatly reduced. Moreover the wound metal studs are formed into a compact configuration so they can be easily recycled. The compact machine easily fits and may be operated conveniently even in very narrow rooms, hallways and elevators. Although this detailed description has set forth particular preferred embodiments of this invention, numerous modifications and variations of this structure and method of this invention, all within the scope of the invention will readily occur to those skilled in the art. Therefore, it is to be understood that this description is illustrative only of the principles of the invention and is not limitative thereof, the scope of the invention being limited solely by the claims appended hereto

What is claimed is:

1. An apparatus for comminuting gypsum board and winding elongate bendable members comprising:

a support structure;

a comminuting mechanism including a housing mounted to said support structure, said housing having an intake portion for receiving gypsum board to be comminuted, an outlet portion for discharging comminuted material, and blade means rotatably mounted in said housing;

a winding mechanism that includes a winding shaft axially rotatably mounted to said support structure, said winding shaft having slot means disposed therein for receiving an elongate bendable member to be wound, and a holder device mounted to said support structure and spaced apart from said winding shaft for accommodating said member to be wound at a location spaced apart from the portion of said member received by said slot means in said winding shaft; and means, mounted to said support structure, for rotatably driving said blade means to comminute gypsum board that is introduced into said housing, and for rotatably driving said winding shaft to wind said bendable member received in said slot means about said winding shaft.

2. The apparatus of claim 1 in which said support structure includes a plurality of support wheels for rolling said apparatus between selected locations.

3. The apparatus of claim 1 in which said housing includes means for securing a collection bag to said housing such that the opening of the bag is in communication with said outlet portion of said housing to receive comminuted material discharged by said outlet portion.

4. The apparatus of claim 1 in which said outlet portion includes a discharge chute.

5. The apparatus of claim 1 in which said housing includes a lid for selectively opening to facilitate cleaning of said housing and closing during operation of said comminuting mechanism.

6. The apparatus of claim 1 in which said housing includes port means disposed above said outlet portion for exhausting dust generated by the comminution process from said housing.

7. The apparatus of claim 1 in which said intake portion includes a slot for receiving gypsum board to be comminuted

8. The apparatus of claim 1 in which said blade means include a plurality of rotary blade elements that extend from a comminuting shaft that is axially rotatably mounted in said housing.

9. The apparatus of claim 8 in which said blade elements are bent at an angle generally longitudinally of said comminuting shaft.

10. The apparatus of claim 8 in which said comminuting mechanism further comprises a frame device including a plurality of meshing elements fixedly attached in said housing for meshing with said blade elements as said blade elements are rotated.

11. The apparatus of claim 8 further comprising flywheel means mounted to at least one end of said comminuting shaft.

12. The apparatus of claim 1 in which said winding shaft includes a generally cylindrical element, said slot means being disposed longitudinally in a sidewall of said cylindrical element.

13. The apparatus of claim 12 further including gripping elements attached to the edges of said slot means for gripping a bendable member received by said slot means.

14. The apparatus of claim 1 in which said means for rotatably driving include a single motor and means for drivably interconnecting said single motor to said blade means and said winding shaft.

15. The apparatus of claim 14 in which said interconnecting means include speed reduction means for operating said blade means at a first selected speed and said winding shaft at a second selected speed.

16. The apparatus of claim 15 in which said speed reduction means include a first speed reducer interconnecting said single motor and both said blade means and said winding shaft and a second speed reducer interconnecting said first speed reducer and said winding shaft.

17. The apparatus of claim 16 in which said blade means include a plurality of rotary blade elements that extend from a comminuting shaft that is axially rotatably mounted in said housing and in which said interconnecting means further comprise means for operably connecting said first speed reducer and said comminuting shaft.

18. The apparatus of claim 14 in which said interconnecting means include clutch means for selectively disengaging said winding shaft from said single motor to permit said comminuting mechanism to operate independently of said winding mechanism.

19. The apparatus of claim 1 in which said means for rotatably driving include a first motor for driving said blade means and a second motor for driving said winding shaft.

20. The apparatus of claim 19 in which said means for rotatably driving include a comminuting speed reducer interconnected between said first motor and said blade means for operating said blade means at a selected speed.

21. The apparatus of claim 19 in which said means for rotatably driving include a winding speed reducer interconnected between said first motor and said winding shaft for operating said winding shaft at a selected speed.

* * * * *